US006439543B1

(12) United States Patent
Peckham

(10) Patent No.: US 6,439,543 B1
(45) Date of Patent: Aug. 27, 2002

(54) LEVELING DEVICE

(76) Inventor: Gary D. Peckham, 2416 Rockhurst, Salina, KS (US) 67401

( * ) Notice: Subject to any disclaimer, the term of this patent is extended or adjusted under 35 U.S.C. 154(b) by 0 days.

(21) Appl. No.: 09/999,137

(22) Filed: Nov. 30, 2001

(51) Int. Cl.[7] ..... E02C 3/00

(52) U.S. Cl. ..... 254/88; 188/32; 33/391; 248/352

(58) Field of Search ..... 254/88; 188/32; 33/391, 370, 333; 152/213 R; 248/352

(56) References Cited

U.S. PATENT DOCUMENTS 3,863,895 A * 2/1975 Grewe et al. ..... 254/88
4,058,292 A 11/1977 Goodrich et al.
4,108,421 A * 8/1978 Extine ..... 254/88
4,165,862 A 8/1979 Bennett
4,427,179 A 1/1984 Price
4,819,910 A 4/1989 Johnston
5,033,146 A * 7/1991 Fogarty et al. ..... 14/69.5
D347,502 S 5/1994 Mazza
5,328,154 A 7/1994 Blatz et al.

* cited by examiner

*Primary Examiner*—M. Rachuba
*Assistant Examiner*—Daniel Shanley

(57) ABSTRACT

A leveling device including a plurality of supports each having a bottom wall, a top wall and a peripheral wall that extends between the top and bottom walls. Each of the bottom walls has a generally rectangular shape. Each of the front walls is angled outward and downward from the top walls to the bottom walls. The supports is stacked on each other with the back walls generally aligned and the bottom walls abutting the top walls such that an upper most support and a lower most support is defined. Each of the bottom walls has a size and shape generally equal to an abutting top wall such that the front walls define a ramp. A selected number of the supports are stacked such that a desired height is achieved. The tire is positioned on the supports such that the recreational vehicle is vertically supported.

7 Claims, 3 Drawing Sheets

LEVELING DEVICE

BACKGROUND OF THE INVENTION

1. Field of the Invention

The present invention relates to leveling devices and more particularly pertains to a new leveling device for allowing a user to lift the wheels of a recreational vehicle for level parking at a campsite.

2. Description of the Prior Art

The use of leveling devices is known in the prior art. U.S. Pat. No. 4,819,910 describes a device for drive on leveling of a recreational vehicle or trailer. Another type of leveling device is U.S. Pat. No. 4,165,862 having a plurality of ramp planks of a predetermined thickness that are stackable on a frame to determine the height of the ramp. Yet another type of leveling device is U.S. Pat. No. 5,328,154 a multi-tiered system of leveler units for leveling of recreational vehicles. Still yet another type of leveling device is U.S. Pat. No. 4,058,292 using multiple adjustable ramps.

While these devices fulfill their respective, particular objectives and requirements, the need remains for a system that is superior to the above mentioned in that it is of durable construction and it's height is easily adjusted. The present invention also has a superior wheel-locking feature, which would prevent the user form driving off the ramp and possible damaging the recreational vehicle. The present invention would also be very light in weight compared to other leveling devices allowing user to easily move the present invention into position.

SUMMARY OF THE INVENTION

The present invention meets the needs presented above by providing a design that is of superior structural design and has few parts allowing the user to easily level their recreational vehicle.

Still yet another object of the present invention is to provide a new leveling device that would be easier to use, reliable, safe, adjustable height, and improved living conditions provided to campers.

Even still another object of the present invention is to provide a new leveling device that the interlocking pieces of this strong plastic product would not shift, slide of crack under pressure, saving the RV owner time and effort in leveling the vehicle.

To this, the present invention generally comprises a plurality of supports each having a bottom wall, a top wall and a peripheral wall that extends between the top and bottom walls. Each of the bottom walls has a generally rectangular shape such that the peripheral walls each include a front wall, a back wall and a pair of sidewalls. Each of the front walls is angled outward and downward from the top walls to the bottom walls. The supports is stacked on each other with the back walls generally aligned and the bottom walls abutting the top walls such that an upper most support and a lower most support is defined. Each of the bottom walls has a size and shape generally equal to an abutting top wall such that the front walls define a ramp. A selected number of the supports are stacked such that a desired height is achieved. The tire is positioned on the supports such that the recreational vehicle is vertically supported.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
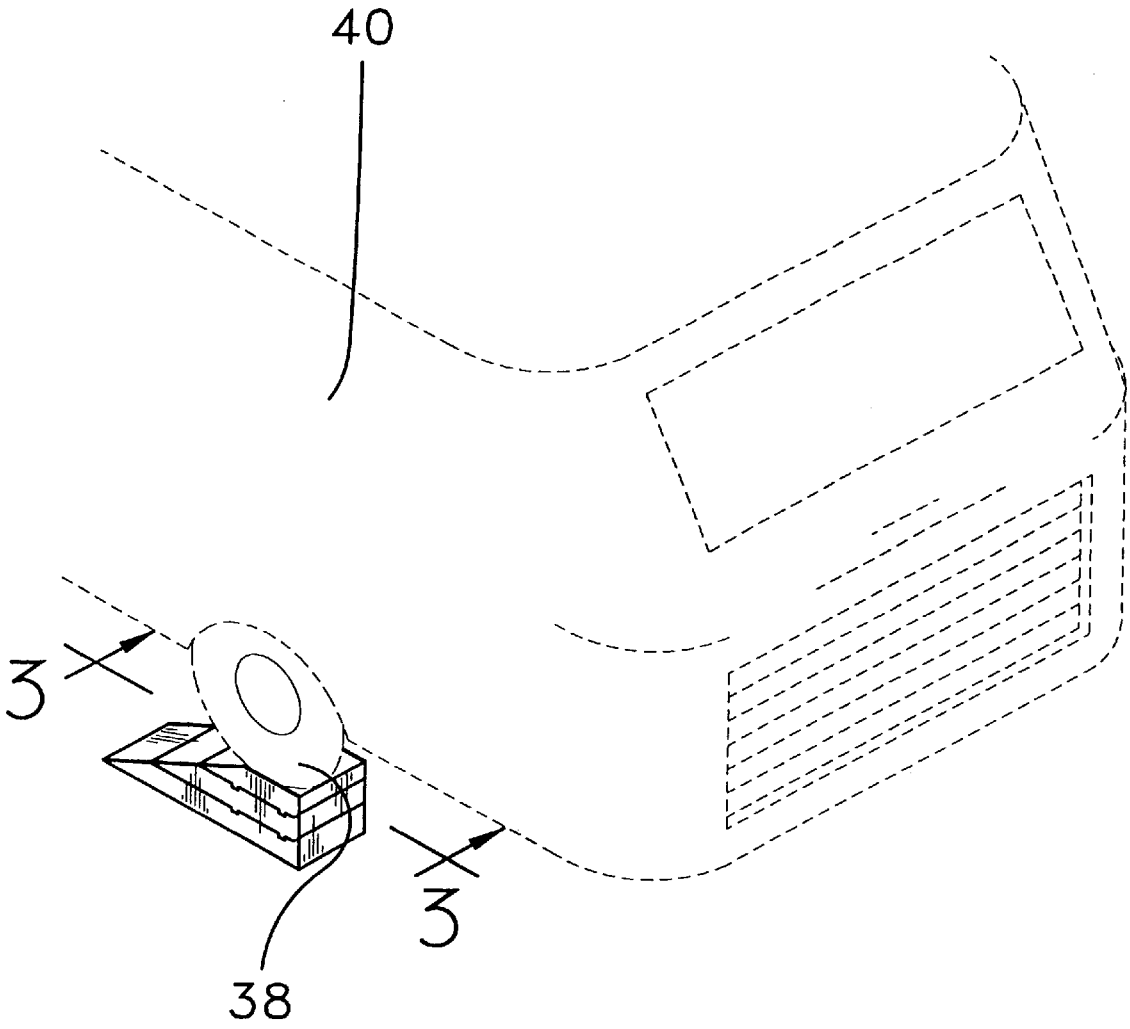
FIG. 1 is a perspective view of a new leveling device according to the present invention.
Figure 2:
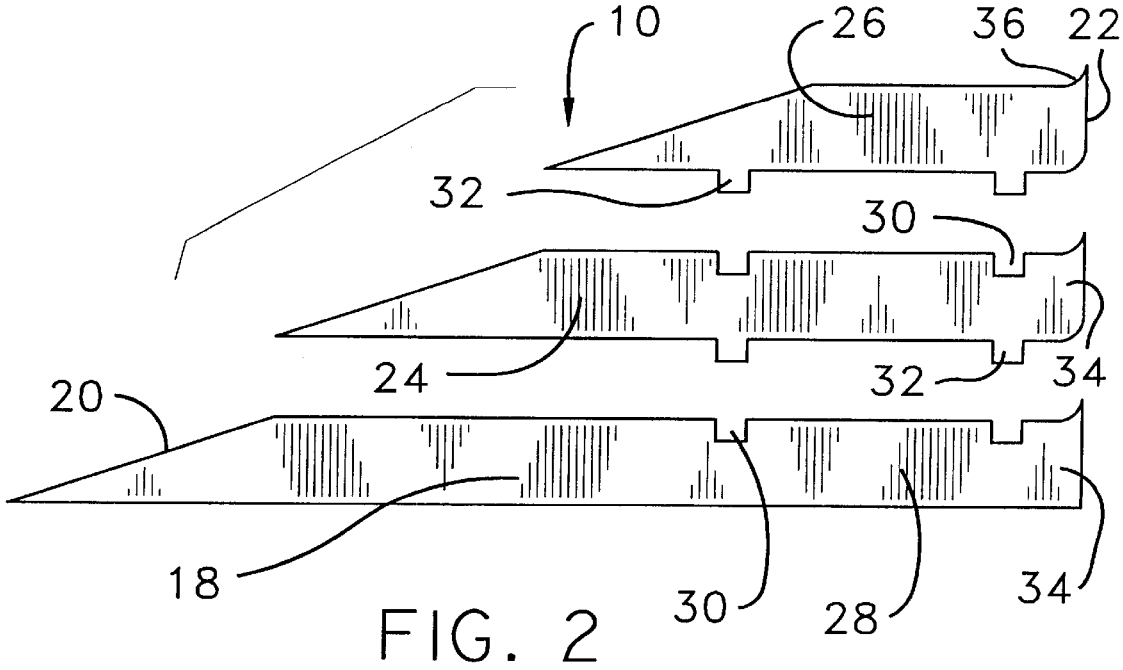
FIG. 2 is a side view of the present invention.
Figure 3:
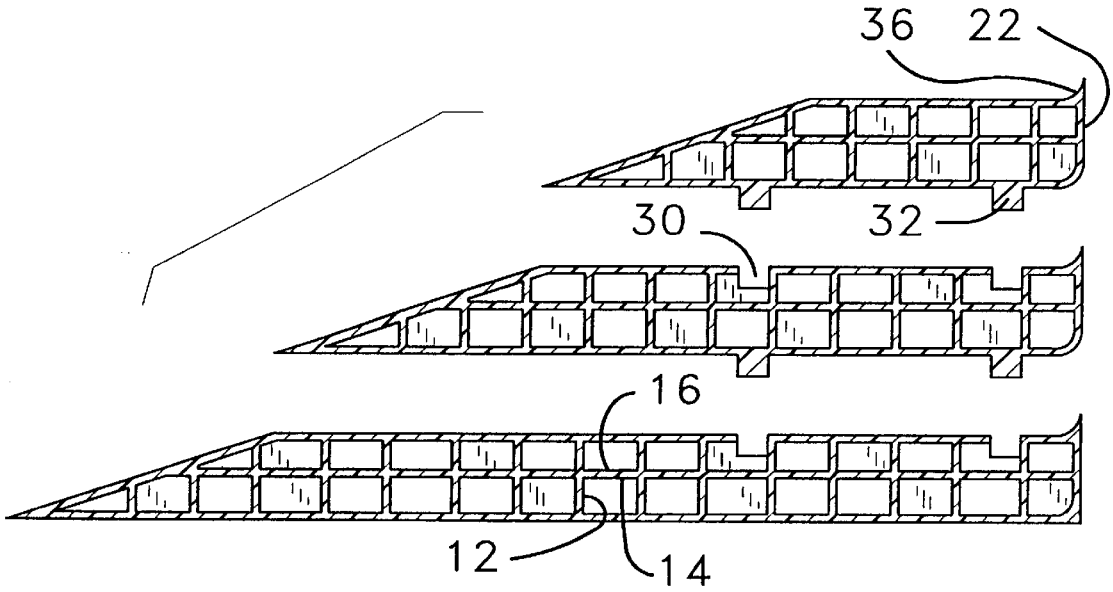
FIG. 3 is a cross-sectional view of the present invention.
Figure 4:
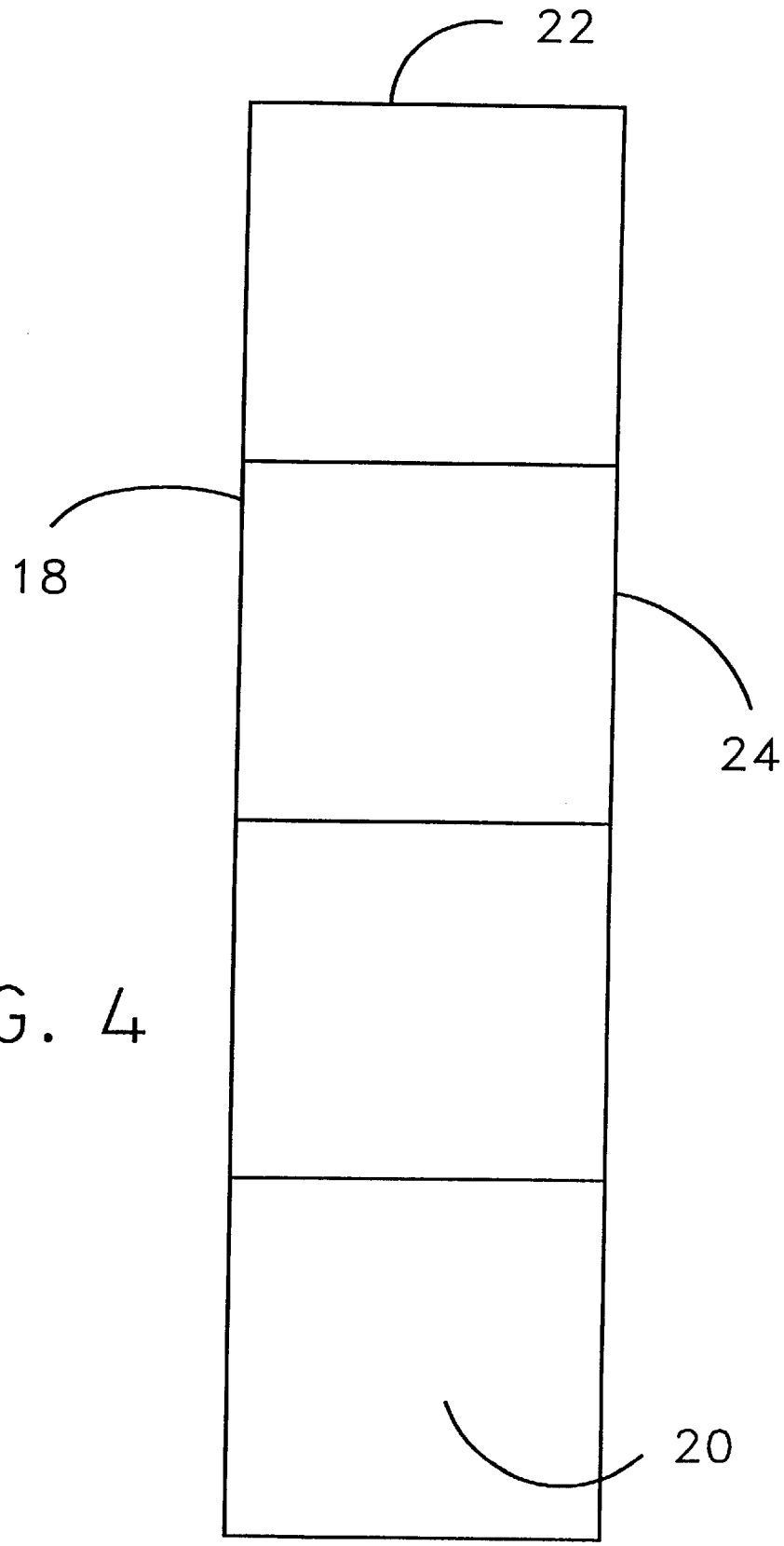
FIG. 4 is a top view of the present invention.

With reference now to the drawings, and in particular to FIGS. 1 through 4 thereof, a new leveling device embodying the principles and concepts of the present invention and generally designated by the reference numeral 10 will be described.

As best illustrated in FIGS. 1 through 4, the leveling device 10 generally comprises a plurality of supports 12 each having a bottom wall 14, a top wall 16 and a peripheral wall 18 that extends between the top 16 and bottom walls 14. Each of the bottom walls 14 has a generally rectangular shape such that the peripheral walls 18 each include a front wall 20, a back wall 22 and a pair of sidewalls 24. Each of the front walls 20 is angled outward and downward from the top walls 16 to the bottom walls 14 such that an angle between the bottom walls 14 and the front walls 20 is generally between 20 degrees and 45 degrees. The supports 12 is stacked on each other with the back walls 22 generally aligned and the bottom walls 14 abutting the top walls 16 such that an upper most support 26 and a lower most support 28 is defined. Each of the bottom walls 14 has a size and shape generally equal to an abutting top wall 16 such that the front walls 20 define a ramp. Each of the top walls 16 of the supports 12 positioned below the upper most support 26 has a plurality of elongated channels 30 for extending between the sidewalls 24. The channels 30 are spaced from each other. The plurality of channels 30 is two channels 30. Each of the bottom walls 14 of the supports 12 positioned above the lower most support 28 has a plurality of elongated ridges 32 thereon extending between the sidewalls 24. Each of the elongated ridges 32 is located to be positioned in one of the channels 30 when the back walls 22 are aligned. The plurality of ridges 32 is two ridges 32. Each of the junctures 34 of the bottom walls 14 and the back walls 22 is rounded. Each of the junctures 34 of the top walls 16 and the back walls 22 has a rounded lip 36 thereon extending upwardly. The plurality of supports 12 includes three supports 12. A selected number of the supports 12 are stacked such that a desired height is achieved. The tire 38 is positioned on the supports 12 such that the recreational vehicle 40 is vertically supported.

In use, a user would position the bottom ground-contacting piece on the ground. The user then would stack additional ramp pieces onto the ground-contacting piece to achieve the desired height in which to raise the RV.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support device for positioning under a tire of a recreational vehicle, said device comprising:

a plurality of supports each having a bottom wall, a top wall and a peripheral wall extending between said top and bottom walls, each of said bottom walls having a generally rectangular shape such that said peripheral walls each include a front wall, a back wall and a pair of side walls, each of said front walls being angled outward and downward from said top walls to said bottom walls, said supports being stacked on each other with said back walls generally aligned and said bottom walls abutting said top walls such that an upper most support and a lower most support is defined, each of said bottom walls having a size and shape generally equal to an abutting top wall such that said front walls define a ramp;

wherein a selected number of said supports are stacked such that a desired height is achieved, wherein the tire is positioned on the supports such that the recreational vehicle is vertically supported; and a juncture between said bottom wall and said back wall of each of said supports being rounded, said top wall and said back wall of each of said supports forming a rounded lip thereon extending upwardly such that said rounded lip selectively receives said juncture between said bottom wall and said back wall of an adjacent one of said supports for maintaining alignment of said supports when said supports are stacked.

2. The support device as in claim 1, wherein an angle between said bottom walls and said front walls is generally between 20 degrees and 45 degrees.

3. The support device as in claim 1, wherein each of said top walls of said supports positioned below said upper most support having a plurality of elongated channels therein extending between said side walls, said channels being spaced from each other, each of said bottom walls of said supports positioned above said lower most support having a plurality of elongated ridges thereon extending between said side walls, each of said elongated ridges being located for being positioned in one of said channels when said back walls are aligned.

4. The support device as in claim 3, wherein said plurality of channels being two channels positioned on each of said supports having channels therein.

5. The support device as in claim 1, wherein each of said junctures of said bottom walls and said back walls being rounded, each of said junctures of said top walls and said back walls having a rounded lip thereon extending upwardly.

6. The support device as in claim 1, wherein said plurality of supports comprising three supports.

7. A support device for positioning under a tire of a recreational vehicle, said device comprising:

a plurality of supports each having a bottom wall, a top wall and a peripheral wall extending between said top and bottom walls, each of said bottom walls having a generally rectangular shape such that said peripheral walls each include a front wall, a back wall and a pair of side walls, each of said front walls being angled outward and downward from said top walls to said bottom walls such that an angle between said bottom walls and said front walls is generally between 20 degrees and 45 degrees, said supports being stacked on each other with said back walls generally aligned and said bottom walls abutting said top walls such that an upper most support and a lower most support is defined, each of said bottom walls having a size and shape generally equal to an abutting top wall such that said front walls define a ramp, each of said top walls of said supports positioned below said upper most support having a plurality of elongated channels therein extending between said side walls, said channels being spaced from each other, said plurality of channels being two channels, each of said bottom walls of said supports positioned above said lower most support having a plurality of elongated ridges thereon extending between said side walls, each of said elongated ridges being located for being positioned in one of said channels when said back walls are aligned, said plurality of ridges being two ridges, each of said junctures of said bottom walls and said back walls being rounded, each of said junctures of said top walls and said back walls having a rounded lip thereon extending upwardly, said plurality of supports comprising three supports; and wherein a selected number of said supports are stacked such that a desired height is achieved, wherein the tire is positioned on the supports such that the recreational vehicle is vertically supported.

* * * * *